US006986512B2

(12) United States Patent
Charpentier

(10) Patent No.: US 6,986,512 B2
(45) Date of Patent: Jan. 17, 2006

(54) WORD GAME AND METHOD OF PLAY

(75) Inventor: Rodolphe Charpentier, Montreal (CA)

(73) Assignee: Prodijeux Inc., Montreal (CA)

( * ) Notice: Subject to any disclaimer, the term of this patent is extended or adjusted under 35 U.S.C. 154(b) by 16 days.

(21) Appl. No.: 10/466,381

(22) PCT Filed: Jan. 18, 2002

(86) PCT No.: PCT/CA02/00109

§ 371 (c)(1),
(2), (4) Date: Jan. 29, 2004

(87) PCT Pub. No.: WO02/056982

PCT Pub. Date: Jul. 25, 2002

(65) Prior Publication Data

US 2004/0119233 A1 Jun. 24, 2004

(30) Foreign Application Priority Data

Jan. 18, 2001 (CA) ..... 2331552

(51) Int. Cl.
*A63F 3/00* (2006.01)

(52) U.S. Cl. ..... 273/272; 273/299

(58) Field of Classification Search ..... 273/272, 273/299; 434/156, 167, 171, 172
See application file for complete search history.

(56) References Cited

U.S. PATENT DOCUMENTS

| | | | | |
|---|---|---|---|---|
| 3,326,557 A | * | 6/1967 | Berendt | 273/272 |
| 4,014,548 A | * | 3/1977 | Trilling | 273/272 |
| 4,026,558 A | | 5/1977 | Patin | 273/137 |
| 4,341,387 A | | 7/1982 | Freyman | 273/240 |
| 4,402,513 A | | 9/1983 | Head | 273/296 |
| 4,448,423 A | | 5/1984 | Augusta | 273/272 |
| 4,601,473 A | | 7/1986 | Dubren et al. | 273/272 |
| 4,690,409 A | | 9/1987 | Scalia | 273/299 |
| 4,690,410 A | | 9/1987 | Berton | 273/299 |
| 4,826,175 A | | 5/1989 | Quatrino | 273/299 |

(Continued)

FOREIGN PATENT DOCUMENTS

CA 773016 12/1967

(Continued)

OTHER PUBLICATIONS

Scrabble Junior, Instructions, www.hasbroscrabble.com, 1 page, 1999.

*Primary Examiner*—William M. Pierce
(74) *Attorney, Agent, or Firm*—Mintz, Levin, Cohn, Ferris, Glovsky and Popeo, P.C.; Ivor R. Elrifi; Nicholas P. Triano, III

(57) ABSTRACT

The present invention provides a word game apparatus and a method of playing said game. The word game apparatus comprising one or more sets of word units having a front, wherein said front has indicia identified thereon comprising an original word, one or more amended words and one or more location identification positions; a plurality of playing pieces having a front having indicia identified thereon representing a letter of an alphabet or a symbol, wherein during play of the game said playing pieces are arranged to form words and a particular formed word is assigned to a particular word unit and said particular word unit is assigned to a particular player, and a playing surface providing a means for displaying said word units such that only an original word is visible. The word game is played according to a playing procedure which provides for the stealing a word unit assigned to an opponent.

11 Claims, 8 Drawing Sheets

U.S. PATENT DOCUMENTS

| | | | | | |
|---|---|---|---|---|---|
| 4,923,199 | A | | 5/1990 | Hahn | 273/299 |
| 4,934,711 | A | | 6/1990 | Runstein | 273/272 |
| 4,973,058 | A | | 11/1990 | Breen | 273/240 |
| 5,054,789 | A | | 10/1991 | Pellerin | 273/288 |
| 5,100,150 | A | | 3/1992 | Larman | 273/272 |
| 5,149,103 | A | | 9/1992 | Ross | 273/432 |
| 5,207,435 | A | | 5/1993 | Tanner | 273/429 |
| 5,306,153 | A | | 4/1994 | Foster | 434/170 |
| 5,324,040 | A | | 6/1994 | Panda | 273/272 |
| 5,458,338 | A | * | 10/1995 | Beardsley | 273/269 |
| 5,564,710 | A | | 10/1996 | Bolding et al. | 273/299 |
| 5,769,421 | A | | 6/1998 | Wakefield | 273/272 |
| 6,234,486 | B1 | | 5/2001 | Wallice | 273/299 |
| 6,279,911 | B1 | | 8/2001 | Cherry | 273/299 |

FOREIGN PATENT DOCUMENTS

| | | |
|---|---|---|
| CA | 1327617 | 3/1994 |
| GB | 775170 | 5/1957 |
| GB | 2251805 A | 7/1992 |
| GB | 2324478 A | 10/1998 |

* cited by examiner

WORD GAME AND METHOD OF PLAY

RESERVATION OF COPYRIGHT

A portion of the disclosure of this patent document contains material to which a claim of copyright protection is made. The owner has no objection to the facsimile reproduction by anyone of the patent document or the patent disclosure as it appears in the Patent and Trademark Office patent file or records, but reserves all other rights whatsoever.

FIELD OF THE INVENTION

The present invention pertains to the field of entertainment and more particularly to games involving the formation of words and apparatus for playing the same.

BACKGROUND

Numerous games are readily available which utilize the skill and imagination of players. More recently, word games have become popular utilizing the word skills of players. Such games are challenging, enjoyable, and simultaneously, have an educational value since they require the imagination of the player, utilizing and expanding their word knowledge.

At the present time, one of the more common word building games is SCRABBLE®. In this game, tiles bearing letters are placed on a board to form a crossword type of arrangement.

The scoring of this game depends partially on arbitrary values given to the letters themselves and partially upon the location at which said tiles are placed on the board. A restriction in SCRABBLE® is that a player is required, when forming a new crossword, to use one letter of a word upon the board or an entire word on the board as a root for the new word. Furthermore, the letters, once formed into a word and placed on the board, are static, and cannot be moved.

U.S. Pat. No. 4,690,410 describes a word forming game, in which a player constructs words using letter tiles. Letter tiles contained either in previously formed words or exposed tiles within the tile pool can be used to create new words. During play it is possible to steal a word previously formed by an opponent. In order to steal a previously formed word, a player must rearrange the letter tiles of the word to be stolen, with the addition of at least one letter tile, such that a new word is created. Upon formation of a new word, a player places the letter tiles forming said word in front of his or her position. The scoring of this game is based upon the number of letter tiles that have been formed into words, which a player has in front of him or herself, in addition to bonus points, if any, signified on said letter tiles.

The above mentioned word games are designed for players with an established vocabulary. Children, however, generally have a limited vocabulary and thus the formation of words, especially the formation of words requiring the inclusion of previously constructed words, becomes more difficult. In order for children to enjoy playing a word game as mentioned above, the method by which the game is played should be modified for simplicity. For example, the aforementioned word game SCRABBLE® has been modified to create a game suitable for children, in which a player is required to match randomly selected letter tiles with the corresponding letters within words, which are printed on one side of the game board in a crossword formation.

In order to maintain the interest of a child a game must be easy to play and entertaining. The present invention provides a method and apparatus for playing a word forming game, which is designed for the enjoyment and education of children by incorporating their identification skills, together with their imagination enabling the formation of words.

U.S. Pat. No. 5,306,153 discloses an educational device which can be used for developing vocabulary and spelling skills which incorporates the spelling of words printed on a board using letter tiles. The device includes a generally rectangular board member that is divided by printed, colored lines into several rectangular sections. Each rectangular section includes a pictorial representation of an object, along with the spelled word corresponding with the name of that object, and a series of side-by-side tile positioning indicia next to the spelled word associated with the illustrated object. A plurality of letter tiles of substantially uniform shape are provided, each letter tile bearing the same color as that of the dividing lines on the board member with which it is to be used, and also bearing a letter of the alphabet on at least one surface. This device while enabling educational purposes does not incorporate the concept of a game in order to possibly maintain the interest of a child upon repeated use of the device.

This background information is provided for the purpose of making known information believed by the applicant to be of possible relevance to the present invention. No admission is necessarily intended, nor should be construed, that any of the preceding information constitutes prior art against the present invention.

SUMMARY OF THE INVENTION

An object of the present invention is to provide a word game and method of play. In accordance with one aspect of the present invention, there is provided a word game apparatus comprising: one or more sets of word units having a front, wherein said front has indicia identified thereon, said indicia comprising an original word, one or more amended words and one or more location identification means; a plurality of playing pieces having a front, said front having indicia identified thereon, wherein said indicia is selected from the group comprising a letter of an alphabet or a symbol and wherein during play of the game said playing pieces are arranged to form words and a particular formed word is assigned to a particular word unit and said particular word unit is assigned to a particular player; and a playing surface providing a means for displaying said word units such that only an original word is visible. The word game is played according to a playing procedure, wherein said playing procedure provides a means for stealing a word unit assigned to an opponent.

In accordance with another aspect of the invention, there is provided a method of playing a word game comprising the steps of: providing a game apparatus to a group of two of more players, said game apparatus comprising a plurality of word units, a plurality of playing pieces and a playing surface; selecting, randomly, a predetermined number of word units and positioning said word units in relation to the playing surface such that only an original word associated with each word unit is visible to the group of two or more players; selecting, randomly, a plurality of playing pieces each having a letter of an alphabet or a symbol indicia thereon, wherein said selected playing pieces are placed in a position such that the group is able to identify the indicia, said selected playing pieces forming an exposed collection; taking possession of a word unit, by a player, upon matching each letter of the original word associated with said word unit with identical letters associated with playing pieces in the exposed collection, wherein said matched playing pieces are subsequently associated with said word unit; attempting to steal a word unit in possession of an opponent through the rearrangement of a group of playing pieces comprising the playing pieces associated with the word unit and at least one additional playing piece from the exposed collection, wherein said rearrangement of the group of playing pieces results in the formation of a word and wherein said word can be selected from a group of amended words associated with the word unit; determining a winner based on a predetermined criteria.

DETAILED DESCRIPTION OF THE INVENTION

Definitions

Figure 1:
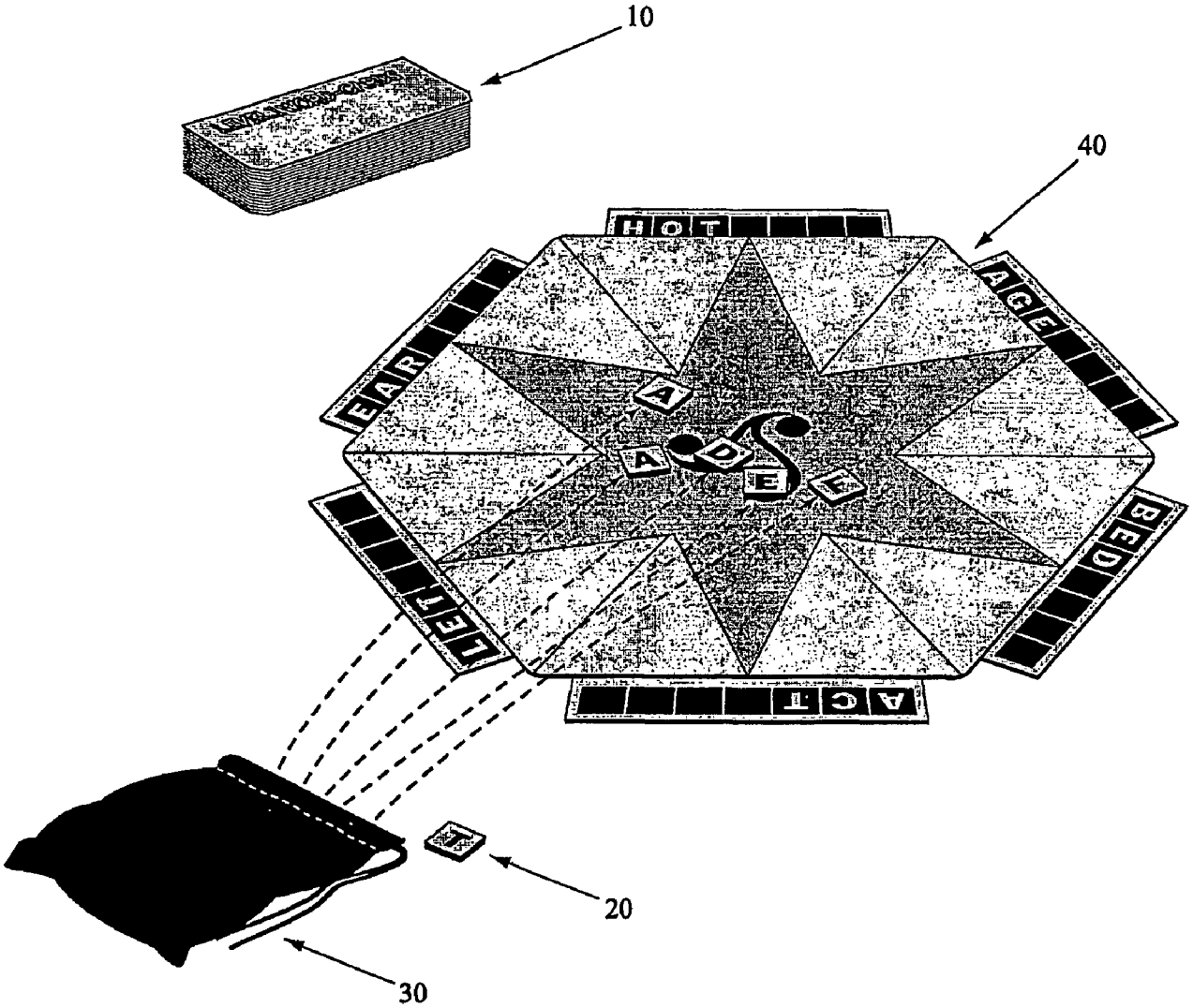
FIG. 1 is a schematic of various components of one embodiment of the present invention.

The term "word unit" is used to describe a means for displaying a plurality of words and location identification means. The plurality of words associated with a particular word unit comprises an original word and plurality of amended words. A word unit can be embodied as a 2 dimensional object or a 3 dimensional object, for example a card or a cube.

The term "location identification means" is used to describe indicia which identify positions for the placement of playing pieces during play of the game.

The term "original word" is used to describe a word associated with a word unit such that the letters of said word must be used for the formation of all new words that are associated with the word unit.

The term "amended word" is used to describe a word which is formed using the letters of an original word together with at least one additional letter.

The term "playing piece" is used to describe a means of displaying a letter in order that the word game may be played. A playing piece can be, for example, a tile or may be embodied in the form of a three dimensional object for example a ball, or a cube.

The term "playing surface" is used to describe any means upon which the game may be played and displayed, for example, a board medium which may be formed from paper, cloth, foam or rubber or some combination thereof. In addition, the playing surface may be associated with a large or a small board medium.

The term "playing procedure" is used to describe a set of rules according to which a game is to be played. The playing procedure establishes the parameters by which for example, a player wins a game or performs particular activities during play of the game and may establish parameters for the validity of particular word formations.

The term "letter" is used to describe any insignia which may be interpreted as a character in an alphabet or may be considered as a "wild" or "joker" insignia. This insignia of a character may be for example a printed letter or a Braille representation of a letter.

The phrase "exposed collection" is used to describe the pool of playing pieces that are visible to all players and can be used to form new words.

The term "player" is used to describe an individual or a group of individuals that are acting as one, who are participating in the game.

The phrase "active player" is used to describe the player that is currently allowed to form words.

Unless defined otherwise defined, all technical and scientific terms used herein have the same meaning as commonly understood by one of ordinary skill in the art to which this invention belongs.

The present invention provides an apparatus and method for playing a word game incorporating word formation. The present invention comprises a plurality of word units, a plurality of playing pieces and a playing surface, wherein each playing piece is associated with a letter or joker insignia A word unit comprises an original word, a plurality of amended words and a plurality of location identification means. During play of the game a player attempts to form a new word using exposed playing pieces, wherein any formed word is associated with a particular word unit. Upon the creation of a new word a player is assigned ownership of the particular word unit with which the new word is associated. The game further incorporates a means for stealing a word unit which in possession of an opponent. During play of the game, a player attempts to collect and maintain possession of a plurality of word units.

In one embodiment of the present invention, the object of the game is to be the first to have possession of a predetermined number of word units, for example 5, 6 or 7. In order to obtain possession of a word unit, a player must spell the original word associated with said word unit using playing pieces within the exposed collection or steal a word unit in possession of an opponent. Preferably, a word unit is stolen from an opponent, with this being accomplished by rearranging the playing pieces associated with the word unit together with at least one additional playing piece, in order to form a new word. At any point in the game, the active player may use any combination of playing pieces within the exposed collection or a set of playing pieces associated with a word unit to form a new word. Each word formed during play of the game is associated with a particular word unit.

A board game apparatus which is suitable for playing a word game as described herein may acquire various forms.

In one embodiment, the board game apparatus may resemble a standard sized board game. In addition, a board game apparatus may be embodied as a travel size game, wherein said apparatus would be of a size providing ease of transport In one embodiment, the present invention can be used as an educational tool, possibly enabling players to expand and develop their vocabulary and improve their spelling. In addition, the present invention may be used as a tool for aiding students developing language skills, for example second and third language education.

In one embodiment of the present invention, the game apparatus can be specifically designed to be compatible with a particular language and the appropriate alphabet of that language.

For example words identified with respect to each word unit will be dependent on the desired language. The particular language can be selected from the group comprising: English, French, Spanish, Portuguese, German, Chinese, Japanese, Arabic and Greek. However, according to the present invention, the word game can be played in any language. In a further embodiment of the present invention the pool of playing pieces which are used to play the game may have a letter ratio which is consistent with the ratio of the use of each particular letter with respect to the particular language in which the game is played. For example, in the English language the letter "E" is the most commonly used letter and therefore may be the most common letter in the pool of playing units.

Board Game Apparatus

With reference to FIG. 1, one embodiment of the present invention comprises a plurality of word units 10, which have associated with them on a collection of words. Furthermore, there is a plurality of playing pieces 20, for example tiles, each of which bears a letter of an alphabet or a joker insignia. Playing pieces of a square shape are shown but they may equally well be round, triangular, hexagonal or some other appropriate 2D or 3D shape. The total number of these playing pieces 10 is not critical, however the ratio of the various insignias can be determined based on the language in which the game is being played or other selected criteria. In one embodiment there is a single joker playing piece contained in the collection of playing pieces. The playing pieces may be supplied, for example, in a container 30, such as a bag having a drawstring, providing a method of random selection of said playing pieces. A playing surface 40 provides a means for exposing randomly selected word units such that only the original word associated with the word unit is visible. Finally, there exists in the view of all players an exposed collection of playing pieces, which are placed for example, on the playing surface. This exposed collection of playing pieces and the playing pieces of preformed words, combined, are the active playing pieces for the game at any given instance.

Word Units

Figure 2:
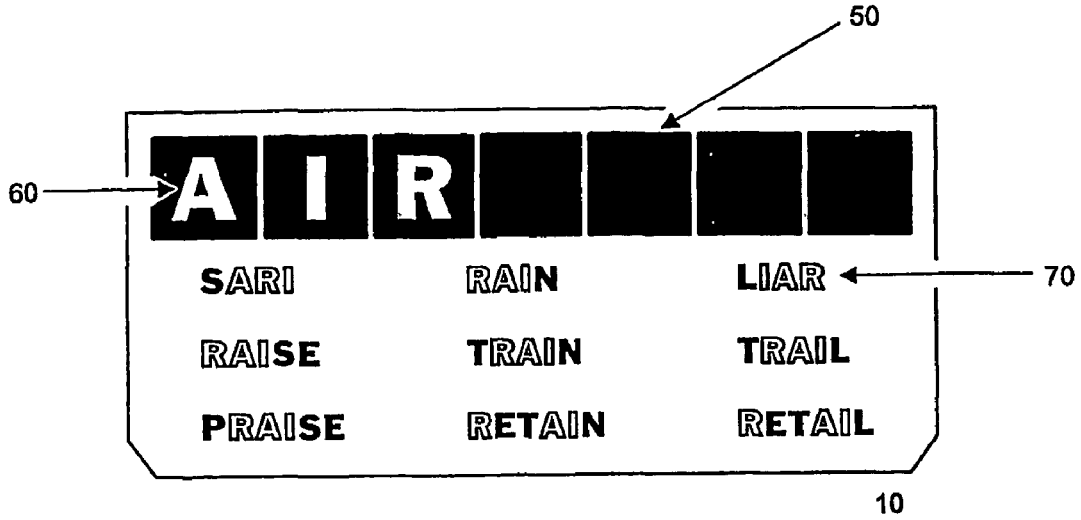
FIG. 2 is a schematic of the components of a word unit according to one embodiment of the present invention.

In one embodiment of the present invention there is supplied a plurality of word units 10 as illustrated in FIG. 2. Each word unit 10 comprises a plurality of location identification means 50, an original word 60 and a collection of amended words 70. The location identification means 50 may, for example, be situated at the top of a word unit 10 and these identification means can indicate positions at which playing pieces may be placed during play of the game. On selected location identification means 50, letters are represented which form a word and this word is the original word 60 associated with the word unit 10 in question. The letters of an original word 60 of a particular word unit 10 form the basis for the creation of amended words 70 associated with said word unit 10. The plurality of additional words imprinted on each word unit identify amended words 70 that may be formed using the letters of the original word 60 together with at least one additional letter.

In one embodiment of the present invention and with reference to FIG. 2, the amended words can be presented such that the letters of the original word are indicated in a different manner that the additional letters to form the new words. For example the letters "A", "I" and "R" are indicated by an outline only and the remainder of the letters are as a solid colour. This identification of the letters of the original word can improve the ease with which a player can determine which letters are required in order to steal a particular word unit.

In one embodiment of the present invention, the amended words are arranged into columns, with each word in a particular column being formed by rearranging a collection of letters. Said collection includes the letters of the word directly above the word in question and at least one additional letter. The plurality of amended words imprinted on each word unit provides suggestions for the stealing of the aforementioned word unit from an opponent.

In one embodiment of the present invention word units can vary in difficulty. For example, a greater number of amended words associated with a particular word unit may increase the possibility of the stealing of said word unit. In this manner the greater the number of amended words associated with a word unit may decrease the difficulty of the game. A player may prefer to construct a word to be associated with a particular word unit that is not listed as an amended word on said word unit. This may increase the difficulty for a future player attempting to steal the above word unit, since that player cannot depend on the associated amended words for suggestions for the creation of a new word.

In one embodiment of the present invention the word units and/or the playing pieces may be designed such that the word units and playing pieces can be temporarily interconnected. For example magnetic attraction or a mechanical connection between these components may provide a means for temporary interconnection of playing pieces and word units. In one embodiment, the interconnection between a playing piece and a word unit is only realised if a playing piece is placed on a location identification means associated with the word unit. This interconnection between game elements can provide a means for maintaining connectivity between said game components during their movement to an alternate position during play of the game. For example the transfer of possession of a word unit after the stealing of said word unit by a player. A temporary mechanical connection may be enabled by, for example, using a hook and eye connection or by providing recesses in a word unit in which playing pieces may be placed. A worker skilled in the art would understand how to construct the playing pieces and word units to produce these forms of temporary interconnection.

In one embodiment of the present invention the word units have images imprinted thereon. These images may provide a player with a pictorial representation of the original word or an amended word associated with a particular word unit, for example.

Playing Surface

In one embodiment of the present invention there is a playing surface formed by the connection of a top surface and a bottom portion, which are connected to provide a space at which word units may be positioned such that only the original words imprinted on said word units are visible. Hexagonal surfaces are shown, although these surfaces may equally well be triangular, rectangular, octagonal or any other shape desired.

Figure 3:
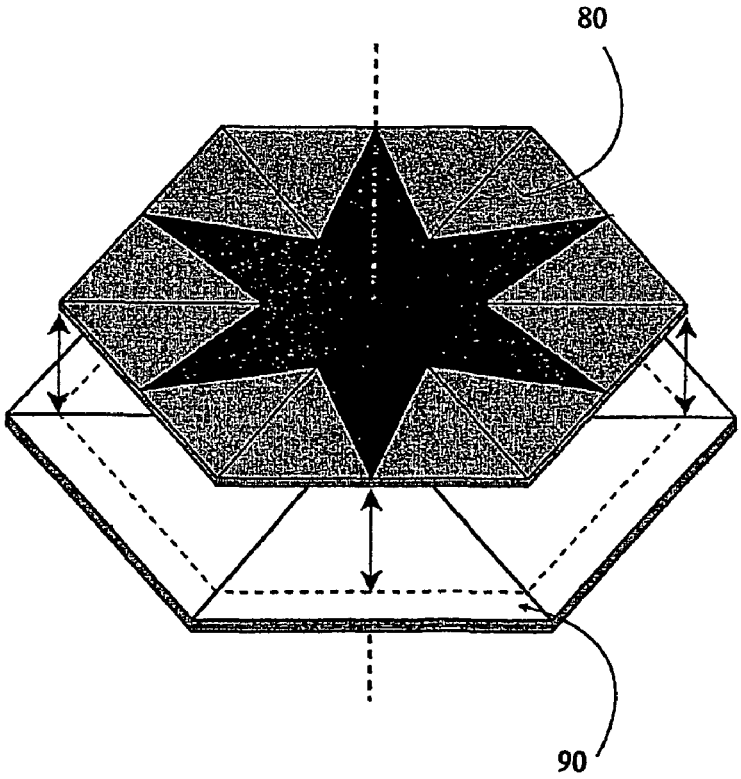
FIG. 3 is a schematic of a game board according to one embodiment of the present invention.

In one embodiment of the present invention, as illustrated in FIG. 3, the top surface 80 has a smaller surface area than the bottom portion 90. The top surface and bottom portion are connected in a manner such that a pocket may formed on each edge of the playing surface. A word unit can be inserted into each of these pockets resulting in the concealment of the amended words associated with a word unit.

In another embodiment of the present invention the top surface has a larger surface area than the bottom portion. When a playing surface of this configuration is placed on a table or the like, a space is realised under the top playing surface such that a word unit can be slipped into said space, thus concealing the amended words.

In one embodiment of the present invention the playing surface is constructed such that it is able to rotate on the surface upon which it is placed. This movement provides a means for each player to read the exposed word units and playing pieces in their correct orientation. This rotation of the playing surface may be provided by a bearing system or any other means as would be known to a worker skilled in the art.

In one embodiment of the present invention, a typical set of game rules is as follows. The following description is defined in terms of the English language and a worker skilled in the art would readily understand how to adapt the following discussion for use with an alternate language.

Standard Method of Play

Set-up

In one embodiment of the present invention, the desired difficulty of a game is chosen and an appropriate deck of word units is selected. Word units are randomly drawn from the selected deck and positioned on the playing surface such that only the original word is exposed and that all possible locations of word units are filled. All playing pieces are placed in a random selection means and a predetermined number of these playing pieces is selected and placed on the playing surface exposing the insignia thereon. These playing pieces form the initial exposed collection. Each player selects one playing piece from the remaining collection of unexposed playing pieces and the player selecting the letter "A" or the letter closest to the letter "A", in the alphabet, begins the game. The order of play proceeds in for example, a clockwise manner commencing with player one, as selected previously. Each of the playing pieces selected by the players, as specified above, is placed in the exposed collection and thus provides the playing pieces to commence the game. Each player proceeds to select an additional playing piece from the container and conceals its value from the rest of the players.

Playing the Game

Player one places their concealed playing piece in the exposed collection and attempts to identify a single playing piece which corresponds to a letter within one of the original words imprinted on an exposed word unit If an appropriate playing piece is located, player one removes said playing piece from the exposed collection and places said playing piece on top of the matching letter imprinted on the word unit. Player one proceeds to select a playing piece from the remaining unexposed collection of playing pieces and conceals its value from the rest of the players.

Player two attempts to identify a single playing piece, which corresponds to a letter contained within one of the original words. Play continues as described above, until matching playing pieces cover an entire original word imprinted on a word unit. When the active player is able to complete an original word by matching the final letter of said word, the word unit and the corresponding playing pieces are placed in front of the active player to indicate the ownership of the word unit. The active player's turn continues until said player is unable to complete an original word or steal an opponent's word unit. Upon completion of a turn the active player selects a playing piece from the remaining unexposed collection of playing pieces and conceals its value from the rest of the players.

One aspect of the game allows for the stealing of a word unit in the possession of an opponent. If the active player can add one or more playing pieces to a previously formed word and thereby form a new word, the active player may steal the corresponding word unit from an opponent. This increases the active player's word unit count and decreases an opponent's word unit count. Imprinted on each of the word units is a collection of amended words that may be formed to enable the stealing of an opponent's word unit. In one embodiment, these amended words are suggestions for stealing a word unit, however, a player may form a different word provided all of the playing pieces associated with the word unit and at least on additional playing piece are used to form this new word.

Furthermore there is provided at least one joker letter, which may be assigned the value of any letter in the alphabet being used, however the value of this playing piece can change over the course of the game. For example, if a joker letter is in play, (for example, contained in one of the pre-formed words), then the active player may steal the joker playing piece by replacing it with a playing piece which results in this pre-formed word still being a valid word. For example, replacing the joker letter contained in the word "*EAN", wherein the "*" represents a joker insignia, with the letter "B" or "L" will result in the formation of a valid word. The joker playing piece is then added to the exposed collection and the active player may assign the joker playing piece any value and use said playing piece to construct a new word.

Figure 4A:
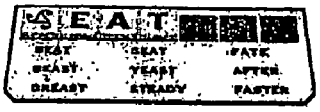
FIG. 4A is a schematic of a word unit during play of a game according to one embodiment of the present and having associated with it a number of playing pieces.
Figure 4B:
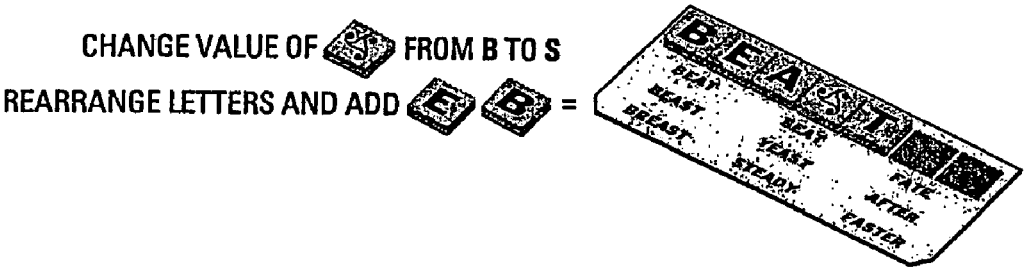
FIG. 4B is a schematic of a first use of a joker letter according to one embodiment of the present invention.
Figure 4C:
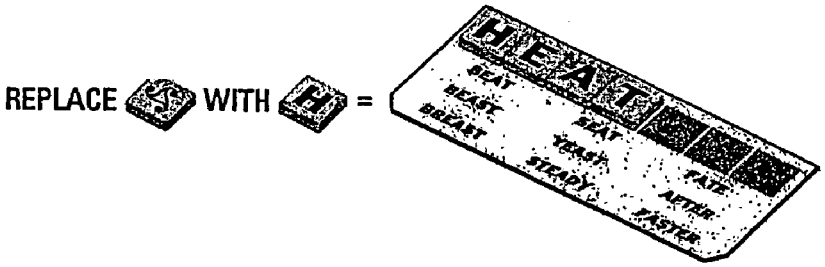
FIG. 4C is a schematic of a second use of a joker letter according to one embodiment of the present invention.
Figure 4D:
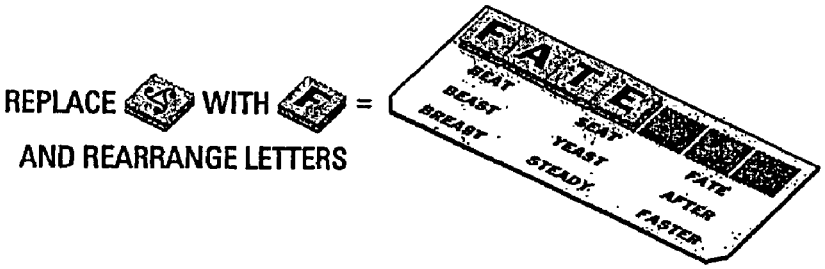
FIG. 4D is a schematic of a third use of a joker letter according to one embodiment of the present invention.

In one embodiment of the present invention and with reference to FIGS. 4A, 4B, 4C and 4D, there are several methods of use of a joker playing piece during the game. FIG. 4A indicates the word unit with the associated playing pieces, which is in the possession of a player. With reference to FIG. 4B, a player can steal a word unit having a word containing the joker playing piece from an opponent by adding at least one playing piece and rearranging these playing pieces to form a new word (e.g. the playing pieces in the preformed word and the additional playing piece). The value of the joker playing piece can be changed to create this new word. With reference to FIG. 4C, one can replace the joker playing piece in a pre-formed word with a letter playing piece from the exposed collection enabling the formation of a valid word as previously described. The joker playing piece in conjunction with playing pieces from the exposed collection and/or pre-formed words can be used to form a new word. With reference to FIG. 4D, the active player can replace the joker playing piece with any playing piece from the exposed collection and rearrange the playing pieces of the pre-formed word including the new playing piece, but excluding the joker playing piece, to create a new word. The joker playing piece, in conjunction with playing pieces from the exposed collection and/or pre-formed words can be used to form a new word.

In one embodiment of the present invention play can continue in a particular direction around the playing surface, for example clockwise or anticlockwise or for example the order of play may be randomly assigned at the beginning of the game.

In one embodiment of the present invention, play of the game proceeds as described above until no further words can be arranged using the exposed collection and/or the pre-formed words or the pool of playing pieces is exhausted or a predetermined number of word units are in the possession of a particular player. Subsequently the player having possession of the largest number of word units is declared the winner.

In a further embodiment, a letter which is associated with a particular playing piece may be assigned a particular value. In this scenario, upon the completion of the game in a manner as previously described, the players may subsequently determine a point total, for example, by adding up the value of the plurality of letters associated with the word units to which they claim ownership. The winner can be determined as the player having the highest point total, for example.

In one embodiment of the present invention, in order to maintain fluidity of the game, the possibility of time limits for the formation of words is possible. For example, a limit of one minute, two minutes or three minutes per word formation attempt may be suitable. The game becomes more difficult if the time limit is reduced and conversely the game is easier if the time limit is increased. In one embodiment of the present invention, there are no pre-assigned time limits.

In a further embodiment, restrictions may also be placed on allowable words, for example, proper nouns, abbreviations and acronyms may not be accepted. It may be useful, however, for a dictionary to be consulted in order to verify the legitimacy of a particular word, if it is so required.

As it would be appreciated by a worker skilled in the art, there is a plurality of strategies which may be used during the course of play of this game. For example, the formation of longer words increases the difficulty for an opponent to steal the associated word unit and thus may be considered a defensive strategy. In addition, constantly attempting to steal the word units of an opponent, thus decreasing their word unit count, may be considered an offensive strategy.

EXAMPLE

In one embodiment of the present invention an example of the sequence of playing the game is illustrated in FIGS. 5–9.

Figure 5:
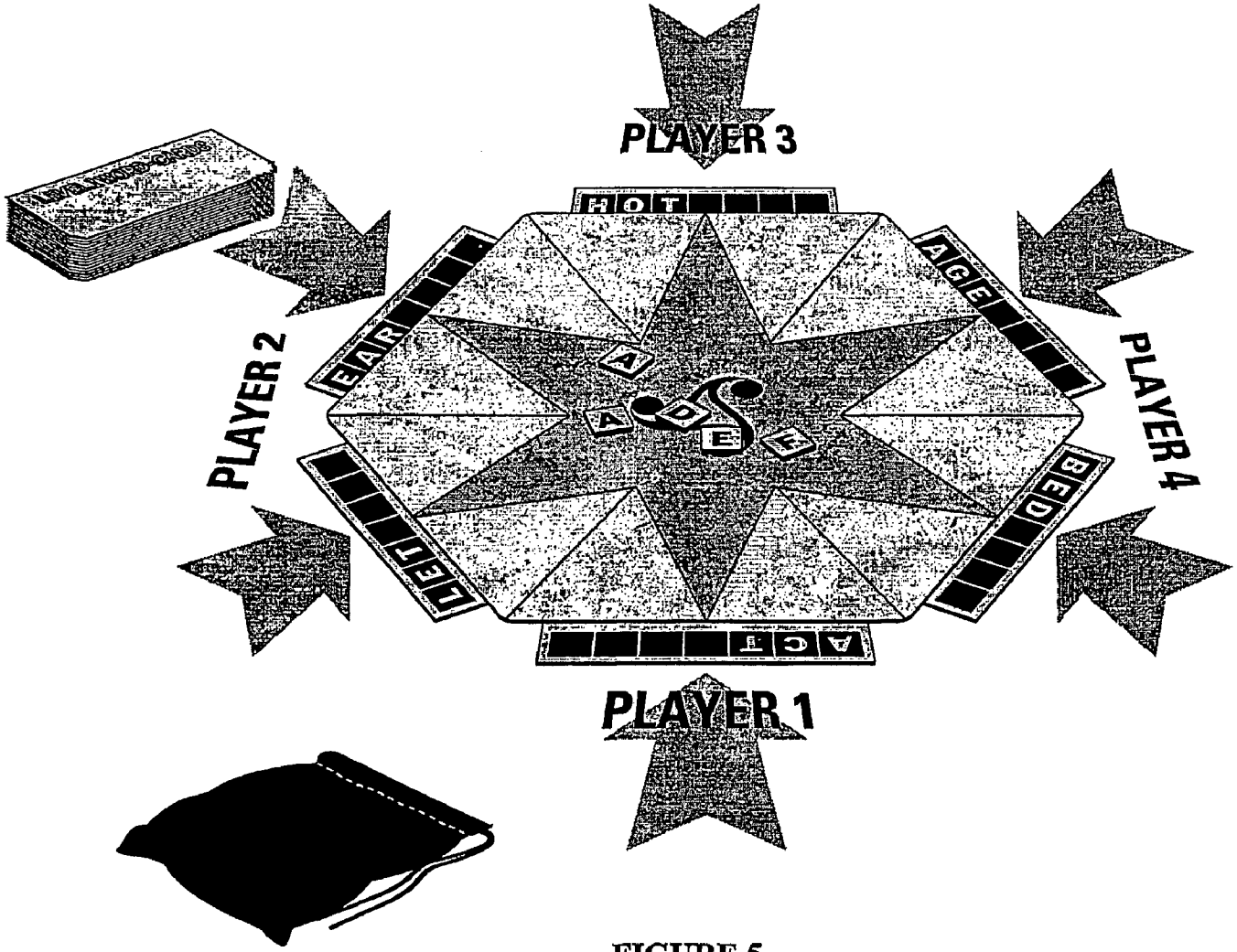
FIG. 5 is a schematic of the initial set up of the game according to one embodiment of the present invention.

Referring to FIG. 5, the initial setup of the game requires the placement of a playing surface in a position allowing full view of said playing surface by all players. Also placed in the playing area is a collection of word units and a container, which contains a plurality of playing pieces with letters imprinted thereon. The difficulty of the game is determined and the appropriate deck of word units is selected. A total of six randomly selected word units are placed under the playing surface such that only the original word imprinted on a word unit is visible. Five random playing pieces are selected from a container or bag, containing the plurality of playing pieces and said five playing pieces are placed on the playing surface exposing the letters thereon.

Figure 6:
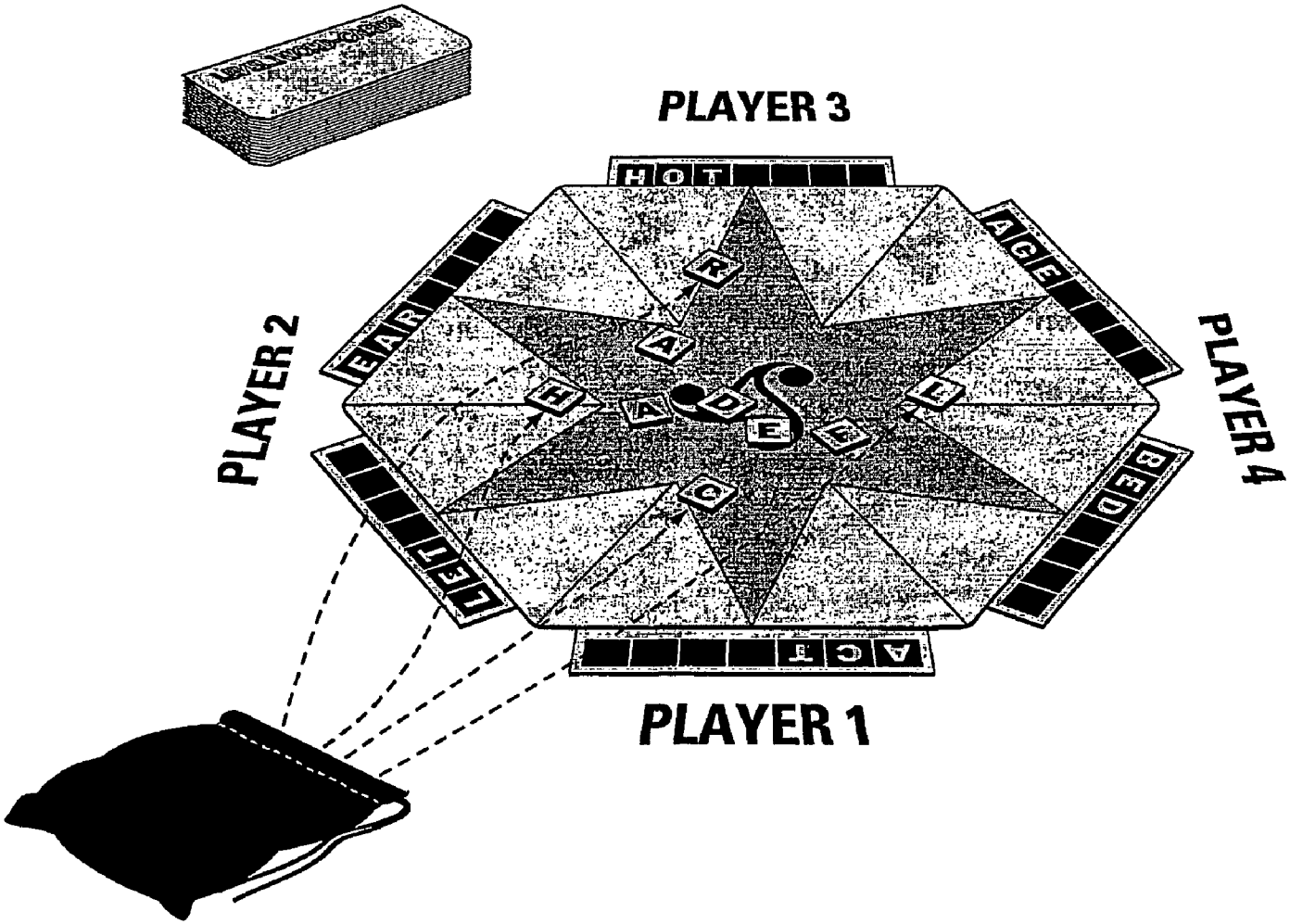
FIG. 6 is a schematic of the method of selection of the first active player according to one embodiment of the present invention.

With reference to FIG. 6, each player draws a playing piece from the remaining unexposed collection of playing pieces in the container and places said playing piece on the playing surface exposing the letter thereon. The player selecting an "A" or the letter closest to an "A" in the alphabet commences plays. In FIG. 6, for example, players 1, 2, 3 and 4, selected a "C", "H", "R" and a "L", respectively. In this example player 1 would commence the game with play proceeding in for example a clockwise direction. These selected playing pieces together with the five playing pieces previously selected, form the exposed collection, which will be located on the playing surface and said playing pieces provide the basis for the commencement of the game.

Figure 7:
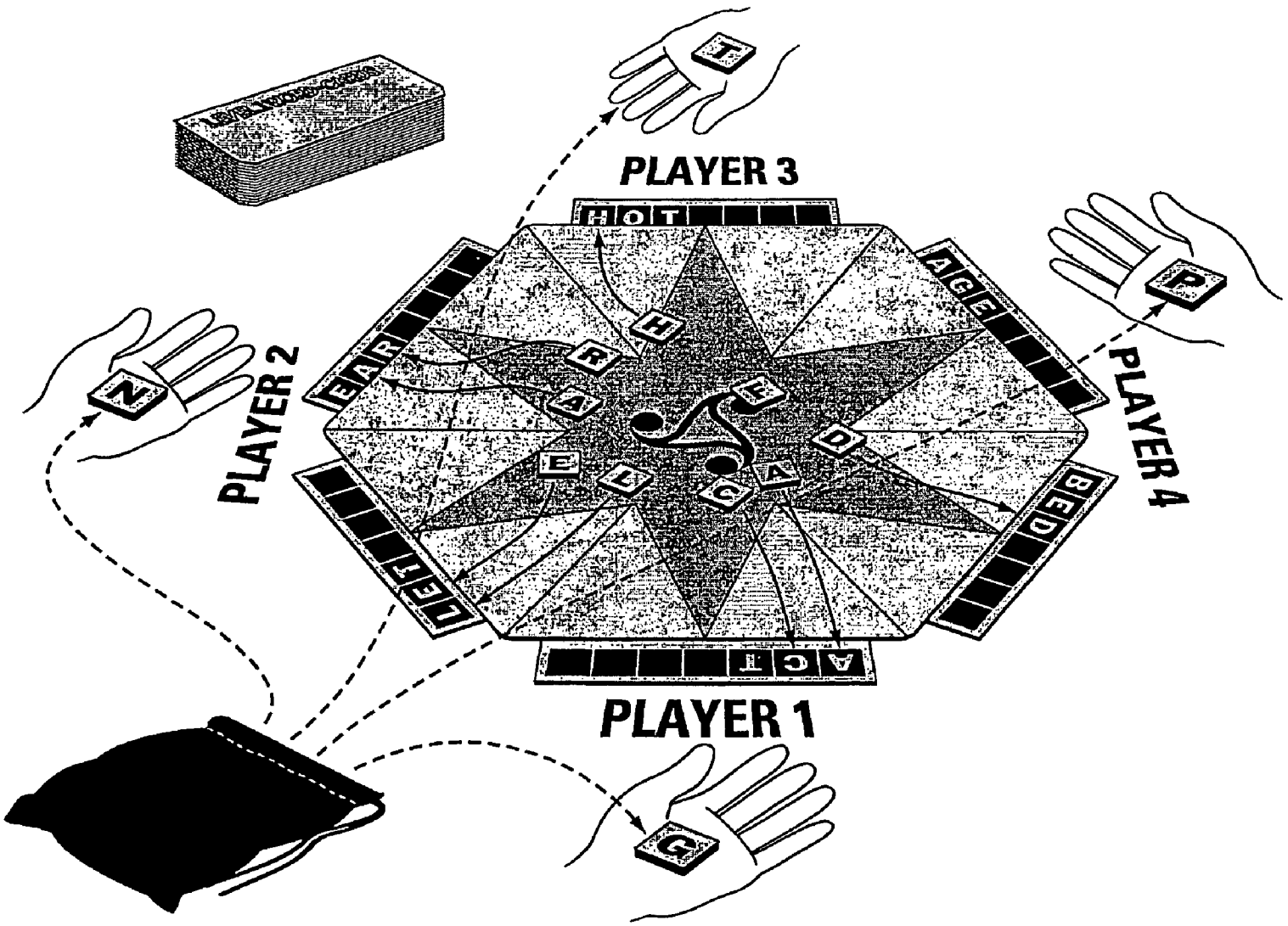
FIG. 7 is a schematic of the method of commencement of play according to one embodiment of the present invention.

With reference to FIG. 7, each player further selects one playing piece from the collection of remaining unexposed playing pieces and conceals said playing piece from view of the other players. Player 1 exposes his or her playing piece and includes it in the exposed collection and attempts to match a playing piece within the exposed collection with a letter contained within one of the exposed original words. For example in FIG. 7, player 1 places the playing piece having the letter "G" imprinted thereon in the exposed collection. Player 1 proceeds to select a playing piece with the letter "E" imprinted thereon, placing said playing piece on top of the "E" contained within the word "LET". Upon completion of this task, player 1 selects a further playing piece from the unexposed collection of playing pieces and conceals said playing piece from view of all other players. Player 2 follows the procedure as stated above. This procedure continues in for example a clockwise direction until an active player is able to cover an entire original word with the appropriate playing pieces.

Figure 8:
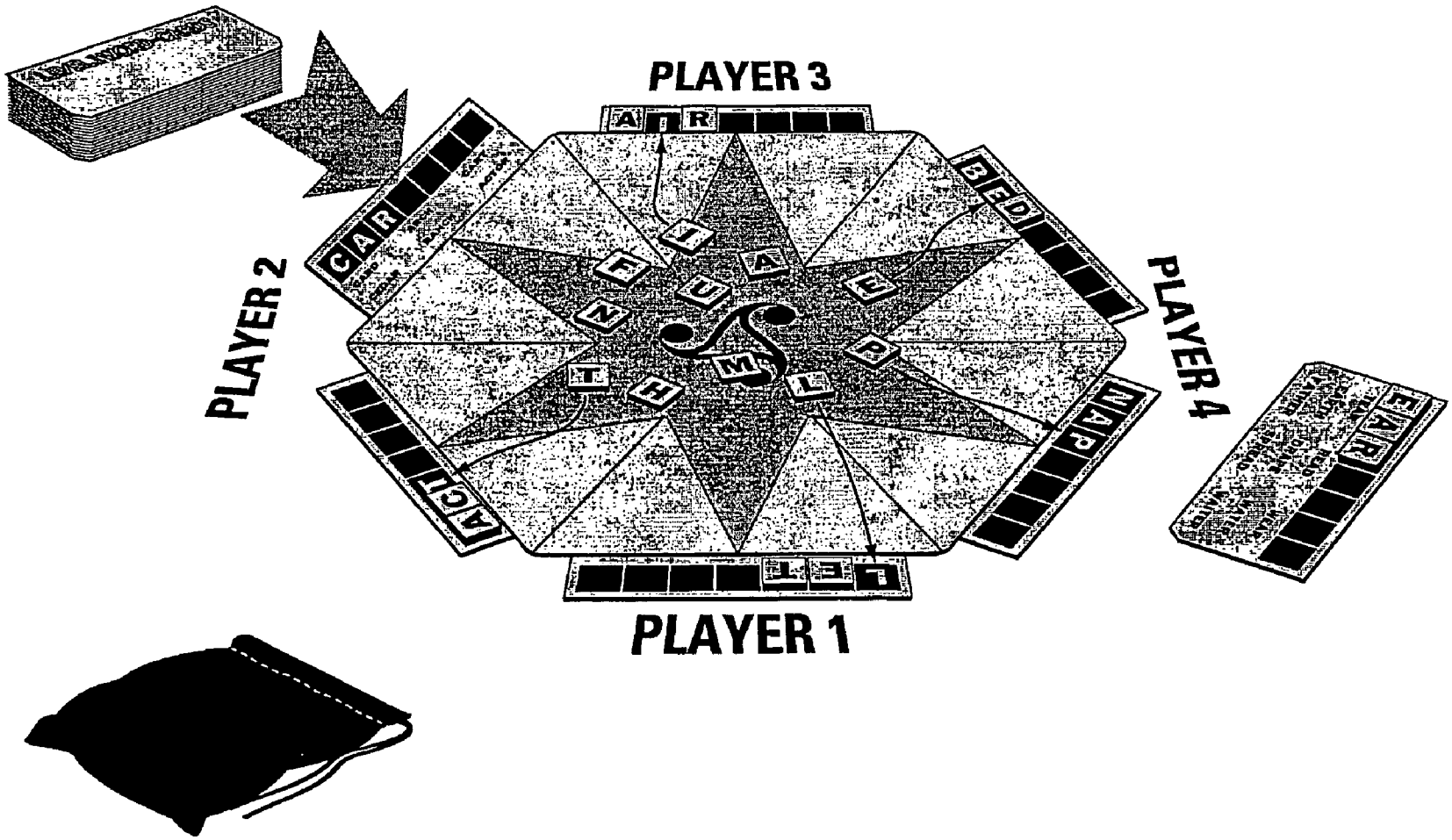
FIG. 8 is a schematic of the procedure of play upon the completion of an original word according to one embodiment of the present invention.

For example, with reference to FIG. 8, player 4 has completed the original word "EAR".

This player then removes the word unit from the playing surface, placing said word unit, together with the corresponding playing pieces, in front of them, thus indicating the ownership of said word unit. The word unit removed from the playing surface is subsequently replaced by another randomly selected word unit from the appropriate deck of word units. Upon replacement of the extracted word unit, player 4 may select a further playing piece from the remaining unexposed collection of playing pieces, placing said playing piece in the exposed collection. This player then proceeds to attempt to match an additional playing piece with a letter contained within an original word. This procedure will continue until player 4 is unable to complete an original word or steal an opponent's word unit, at which point player 4 will select a playing piece from the remaining unexposed collection of playing pieces and conceal its value.

Figure 9:
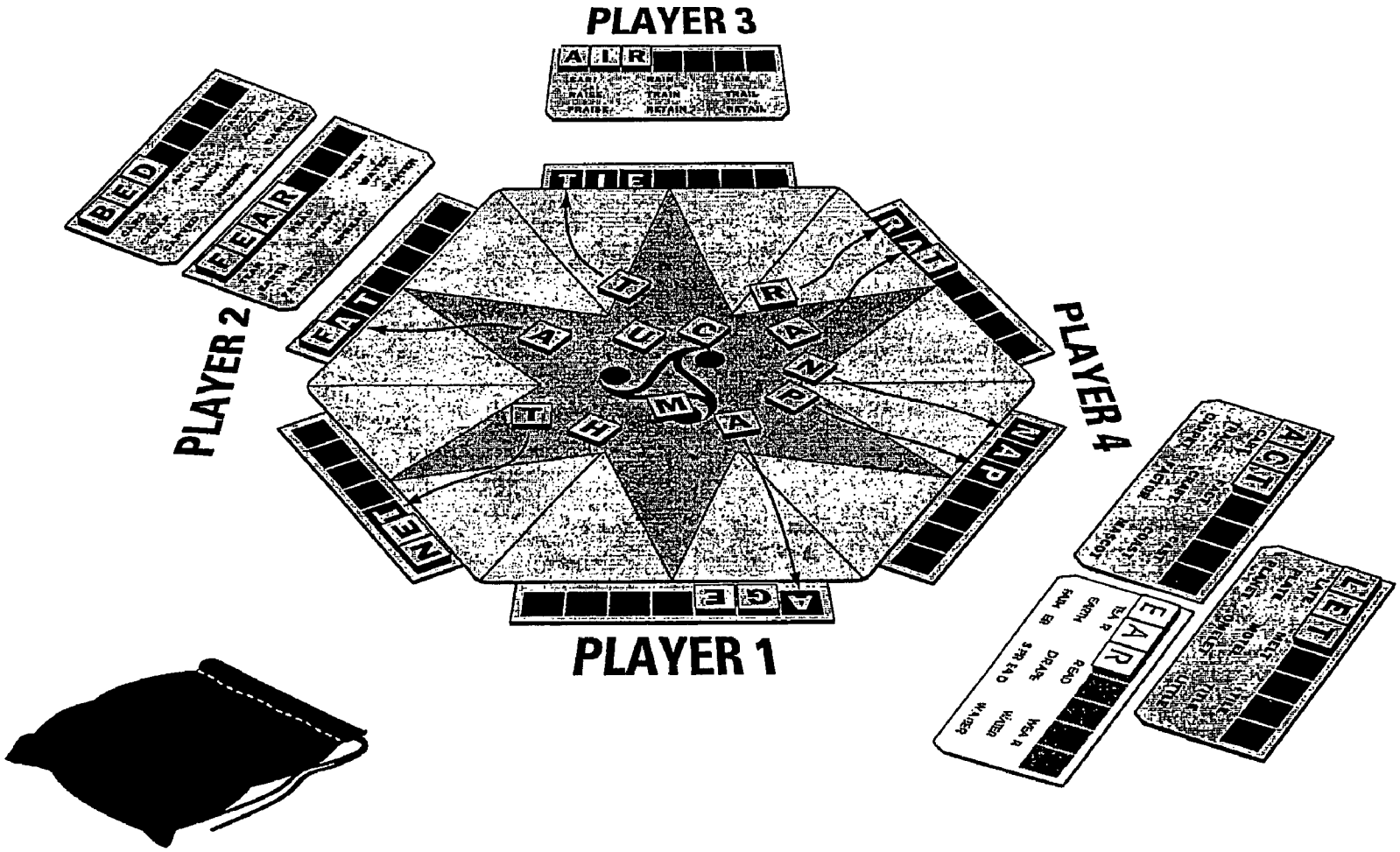
FIG. 9 is a schematic of the procedure for the stealing of an opponent's word unit according to one embodiment of the present invention.

FIG. 9 illustrates the procedure by which a player may steal an opponent's word unit. In order for the active player to steal a word unit from an opponent, the active player must add at least one playing piece to the playing pieces associated with said word unit and rearrange all of these playing pieces to form a new word. For example, player 2 adds the letter "F" to the word "EAR" associated with the word unit in the possession of player 4, thus forming the word "FEAR". Player 2 proceeds to take the word unit together with the associated playing pieces, from player 4, proceeding to place them in front of their position.

The game will proceed in this fashion as stated above until all players are unable to complete an original word or steal an opponent's word unit. Alternately, play may continue until a particular player has possession of a predetermined number of word units. The player with the most word units in their possession is declared the winner.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A word game apparatus comprising: a) one or more sets of word units having a front, wherein said front has indicia identified thereon, said indicia comprising an original word, one or more amended words and one or more location identification means; b) a plurality of playing pieces having a front, said front having indicia identified thereon, wherein said indicia is selected from the group comprising a letter of an alphabet or a symbol and wherein during play of the game said playing pieces are arranged to form words and a particular formed word is assigned to a particular word unit and said particular word unit is assigned to a particular player; and c) a playing surface providing a means for displaying said word units such that only an original word is visible; wherein said word game is played according to a playing procedure, wherein said playing procedure provides a means for stealing a word unit assigned to an opponent.

2. The word game apparatus according to claim 1, wherein all amended words associated with a particular word unit comprise the letters of the original word associated with said particular word unit and at least one additional letter.

3. The word game apparatus according to claim 1, wherein said symbol represents any letter within the alphabet, wherein said symbol is assigned a letter during play of the game and said symbol can be reassigned a different letter at any point during play of the game.

4. The word game apparatus according to claim 1, wherein said means for stealing a word unit includes instructions for rearranging a group of playing pieces comprising playing pieces associated with the word unit and at least one additional playing piece, wherein said rearranging of the group of playing pieces results in a new word being formed and said word is associated with the word unit.

5. The word game of claim 1, wherein said location identification means comprises indicia for identifying positions at which playing pieces can be positioned during play of the game.

6. The word game apparatus according to claim 1, wherein said alphabet is consistent with a language selected from the group comprising: English, French, Spanish, Portuguese, German, Arabic, Greek, Chinese and Japanese.

7. A method of playing a word game comprising the steps of a) providing a game apparatus to a group of two of more players, said game apparatus comprising a plurality of word units, a plurality of playing pieces and a playing surface; b) selecting, randomly, a predetermined number of word units and positioning said word units in relation to the playing surface such that only an original word associated with each word unit is visible to the group of two or more players; c) selecting, randomly, a plurality of playing pieces each having a letter of an alphabet or a symbol indicia thereon, wherein said selected playing pieces are placed in a position such that the group is able to identify the indicia, said selected playing pieces forming an exposed collection; d) taking possession of a word unit, by a player, upon matching each letter of the original word associated with said word unit with identical letters associated with playing pieces in the exposed collection, wherein said matched playing pieces are subsequently associated with said word unit; e) attempting to steal a word unit in possession of an opponent through the rearrangement of a group of playing pieces comprising the playing pieces associated with the word unit and at least one additional playing piece from the exposed collection, wherein said rearrangement of the group of playing pieces results in the formation of a word and wherein said word can be selected from a group of amended words associated with the word unit; f) determining a winner based on a predetermined criteria.

8. The method of playing a word game according to claim 7, wherein each player becomes an active player in a predetermined manner, wherein the active player can take possession of a word unit or attempt to steal a word unit.

9. The method of playing a word game according to claim 7, wherein the symbol associated with one or more playing pieces can be assigned a letter value during play of the game and said symbol can be reassigned a different letter value at any point during play of the game.

10. The method of playing a word game according to claim 7, wherein the group of amended words associated with a word unit are comprise letters of the original word and at least one additional letter.

11. The word game of claim 2, wherein said location identification means comprises indicia for identifying positions at which playing pieces can be positioned during play of the game.

* * * * *